US008339027B2

(12) United States Patent
Liu et al.

(10) Patent No.: US 8,339,027 B2
(45) Date of Patent: Dec. 25, 2012

(54) FIELD EMISSION DEVICE WITH ELECTRON EMISSION UNIT AT INTERSECTION AND FIELD EMISSION DISPLAY USING THE SAME

(75) Inventors: Peng Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/156,523

(22) Filed: Jun. 9, 2011

(65) Prior Publication Data

US 2012/0169212 A1 Jul. 5, 2012

(30) Foreign Application Priority Data

Dec. 29, 2010 (CN) ..... 2010 1 0612655

(51) Int. Cl.
*H01J 1/62* (2006.01)
*H01J 63/04* (2006.01)

(52) U.S. Cl. ..... 313/495; 313/498; 313/496; 313/497; 313/309; 313/311

(58) Field of Classification Search ..... 313/495–497, 313/306, 309–311
See application file for complete search history.

(56) References Cited

U.S. PATENT DOCUMENTS

| | | | | |
|---|---|---|---|---|
| 6,445,122 | B1 * | 9/2002 | Chuang et al. | 313/495 |
| 7,067,336 | B1 * | 6/2006 | Kyogaku et al. | 438/20 |
| 7,967,655 | B2 * | 6/2011 | Wei et al. | 445/51 |
| 8,237,344 | B2 * | 8/2012 | Wei et al. | 313/495 |
| 8,283,861 | B2 * | 10/2012 | Liu et al. | 313/506 |
| 2005/0073261 | A1 * | 4/2005 | Takeuchi et al. | 315/169.1 |
| 2007/0035230 | A1 * | 2/2007 | Lin et al. | 313/496 |
| 2007/0096075 | A1 * | 5/2007 | Li et al. | 257/10 |
| 2007/0257865 | A1 * | 11/2007 | Bajk et al. | 345/75.2 |
| 2009/0236965 | A1 | 9/2009 | Liu et al. | |

FOREIGN PATENT DOCUMENTS

| | | | |
|---|---|---|---|
| CN | 1433039 | A | 7/2003 |
| CN | 1909177 | A | 2/2007 |
| CN | 101540260 | A | 9/2009 |
| JP | 2006173007 | A * | 6/2006 |

OTHER PUBLICATIONS

English abstract of JP 2006173007 A to Kitahara et al.*

* cited by examiner

*Primary Examiner* — Sikha Roy
(74) *Attorney, Agent, or Firm* — Altis Law Group, Inc.

(57) ABSTRACT

A field emission display includes an insulating substrate, a number of first electrode down-leads, a number of second electrode down-leads, and a number of electron emission units. The first electrode down-leads are set an angle relative to the second electrode down-leads to define a number of cells and a number of intersections. Each electron emission unit is located at one of the plurality of intersections and in at least two adjacent cells. The electron emission unit includes a first electrode, a second electrode, and a plurality of electron emitters. The second electrode extends surrounding the first electrode. The plurality of electron emitters located on and electrically connected to at least one of the first electrode and the second electrode. A field emission display is also provided.

19 Claims, 9 Drawing Sheets

FIELD EMISSION DEVICE WITH ELECTRON EMISSION UNIT AT INTERSECTION AND FIELD EMISSION DISPLAY USING THE SAME

CROSS-REFERENCE TO RELATED APPLICATIONS

This application claims all benefits accruing under 35 U.S.C. §119 from China Patent Application No. 201010612655.6, filed on Dec. 29, 2010 in the China Intellectual Property Office, disclosure of which is incorporated herein by reference. This application is related to applications entitled, "FIELD EMISSION DISPLAY", filed Jun. 9, 2011 Ser. No. 13/156,513; and "FIELD EMISSION DEVICE AND FIELD EMISSION DISPLAY", filed Jun. 9, 2011 Ser. No. 13/156,517.

BACKGROUND

1. Technical Field

The present disclosure relates to a field emission device and a field emission display.

2. Description of Related Art

Field emission displays (FED) can emit electrons under the principle of a quantum tunnel effect opposite to a thermal excitation effect, which is of great interest from the viewpoints of low power consumption.

A field emission display, according to the prior art usually includes a transparent plate, an insulating substrate opposite to the transparent plate, a number of supporters, and one or more cells located on the insulating substrate. Each cell includes a pixel unit. The pixel unit includes a rectangular first electrode, a rectangular second electrode spaced from and parallel to the first electrode, at least one electron emitter connected to the first electrode, and a phosphor layer located on the second electrode. However, the brightness of the field emission display is relatively low.

What is needed, therefore, is to provide a field emission display having relatively high brightness.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present field emission device and field emission display.

Figure 1:
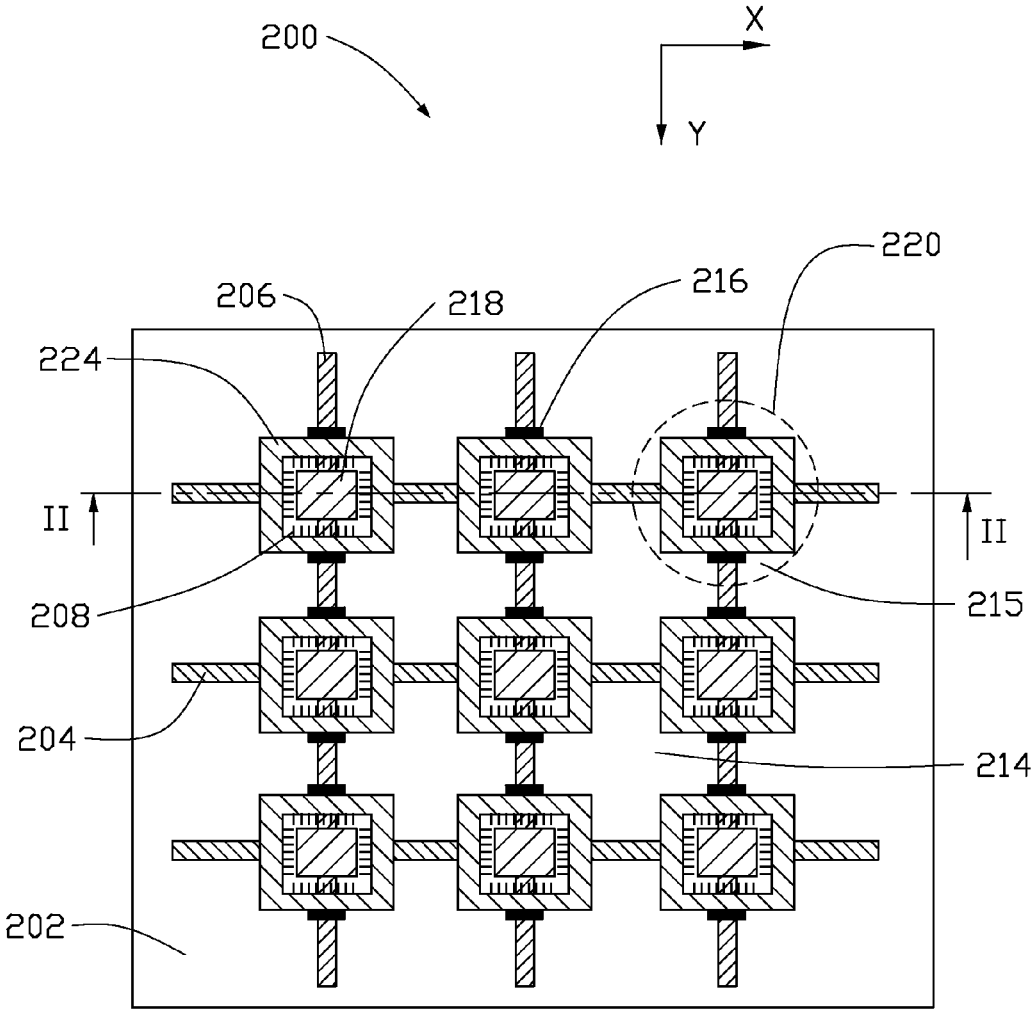
FIG. 1 is a schematic, top view of one embodiment of a field emission display.
Figure 2:
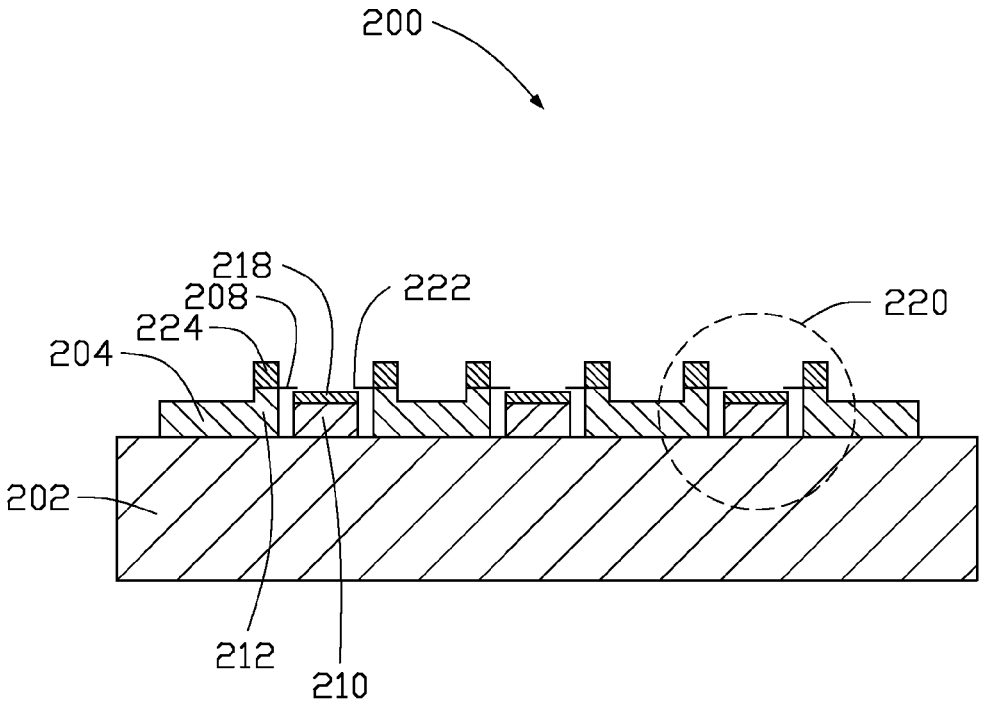
FIG. 2 is a schematic, cross-sectional view, along a line II-II of FIG. 1.

Referring to FIGS. 1 and 2, a field emission display 200 of one embodiment includes an insulating substrate 202, a number of substantially parallel first electrode down-leads 204, a number of substantially parallel second electrode down-leads 206, and a number of pixel units 220 arranged to form an array.

The first electrode down-leads 204 and the second electrode down-leads 206 are located on the insulating substrate 202. The first electrode down-leads 204 are generally set at an angle to the second electrode down-leads 206 to form a grid and define a number of cells 214 and intersections 215. A cell 214 is defined by two substantially adjacent first electrode down-leads 204 and two substantially adjacent second electrode down-leads 206 of the grid. Any one of the first electrode down-leads 204 and any one of the second electrode down-leads 206 can define an intersection 215. The first electrode down-leads 204 and the second electrode down-leads 206 are electrically insulated at the intersections 215. In FIG. 1, the first electrode down-leads 204 are broken at the intersections 215. Each of the pixel units 220 is located at one of the intersections 215. In FIG. 1, the lengthwise direction of the first electrode down-leads 204 is defined as an X direction, and the lengthwise direction of the second electrode down-leads 206 is defined as a Y direction.

The insulating substrate 202 is configured for supporting the first electrode down-leads 204, the second electrode down-leads 206, and the pixel units 220. The shape, size, and thickness of the insulating substrate 202 can be chosen according to need. The insulating substrate 202 can be made of material such as ceramic, glass, resin, or quartz. In one embodiment, the insulating substrate 202 is a square glass substrate with a thickness of about 1 millimeter and an edge length of about 1 centimeter.

The first electrode down-leads 204 are located equidistantly apart. A distance between two adjacent first electrode down-leads 204 can range from about 50 micrometers to about 2 centimeters. The second electrode down-leads 206 are located equidistantly apart. A distance between adjacent two second electrode down-leads 206 can range from about 50 micrometers to about 2 centimeters. A suitable orientation of the first electrode down-leads 204 and the second electrode down-leads 206 are set at an angle with respect to each other. The angle can range from about 10 degrees to about 90 degrees. In one embodiment, the angle is 90 degrees, and the cell 214 is a square area.

The first electrode down-leads 204 and the second electrode down-leads 206 are made of conductive material such as metal or conductive slurry. In one embodiment, the first electrode down-leads 204 and the second electrode down-leads 206 are formed by applying conductive slurry on the insulating substrate 202 using screen printing process, the conductive slurry being composed of metal powder, glass powder, and binder. The metal powder can be silver powder, the glass powder has a low melting point, and the binder can be terpineol or ethyl cellulose (EC). The conductive slurry can include about 50% to about 90% (by weight) of the metal powder, about 2% to about 10% (by weight) of the glass powder, and about 8% to about 40% (by weight) of the binder. In one embodiment, each of the first electrode down-leads 204 and the second electrode down-leads 206 is formed with a width in a range from about 30 micrometers to about 100 micrometers and with a thickness in a range from about 10 micrometers to about 50 micrometers. However, it is noted that dimensions of each of the first electrode down-leads 204 and the second electrode down-leads 206 can vary corresponding to the dimension of each cell 214.

The pixel unit 220 includes a first electrode 212, a second electrode 210, an electron emitter 208, and a phosphor layer 218. The first electrode 212 and the second electrode 210 are located on the insulating substrate 202 and spaced from each other. At least part of the first electrode 212 extends surrounding the second electrode 210. The first electrode 212 can be L-shaped, U-shaped, C-shaped, semicircular-shaped or ring-shaped. The pixel unit 220 can be located at one of the intersections 215 and in at least two adjacent cells 214. In FIG. 1, each pixel unit 220 is located in four adjacent cells 214. The second electrodes 210 and the first electrode down-leads 204 are spaced from each other. A plurality of insulators 216 is sandwiched between the first electrodes 212 and the second electrode down-leads 206 to avoid short-circuiting. The insulators 216 are located at every intersection of the first electrode 212 and the second electrode down-leads 206 for providing electrical insulation. In one embodiment, the insulator 216 is a dielectric insulator.

The first electrode 212 is used as a cathode electrode and electrically connected to the first electrode down-lead 204. The second electrode 210 is used as an anode electrode and electrically connected to the second electrode down-lead 206. The electron emitter 208 is located between the first electrode 212 and the second electrode 210, and extends from the first electrode 212 toward the second electrode 210. In one embodiment, one end of the electron emitter 208 is electrically connected to the first electrode 212, and the other end of the electron emitter 208 points to the second electrode 210 and is used as an electron emission portion 222. The electron emission portion 222 is spaced from the second electrode 210. The electron emitter 208 is suspended above the insulating substrate 202. The phosphor layer 218 is located on a surface of the second electrode 210. The electrons emitted from the electron emitter 208 can bombard the phosphor layer 218 to light.

The second electrode 210 is a conductor such as a metal layer, ITO layer, or conductive slurry layer. In one embodiment, the second electrode 210 and the second electrode down-lead 206 are made by printing conductive slurry at the same time. The second electrode 210 can be a planar conductor. The size and shape of the second electrode 210 can be selected according to the size of the cell 214. In one embodiment, the second electrode 210 is a square planar conductor with a side length of about 30 micrometers to about 15 millimeters and a thickness of about 10 micrometers to about 500 micrometers. In one embodiment, the second electrode 210 is a square planar conductor with a side length of about 100 micrometers to about 700 micrometers and a thickness of about 20 micrometers to about 100 micrometers.

The first electrode 212 is a conductor such as a metal layer, ITO layer, or conductive slurry layer. In one embodiment, the first electrode 212 and the first electrode down-lead 204 are made by printing conductive slurry at the same time. The first electrode 212 can be a planar conductor with a rectangular cross section. The size and shape of first electrode 212 can be selected according to the size and shape of the second electrode 210. In one embodiment, the first electrode 212 is a square frame around the second electrode 210. The first electrodes 212 can have a width in a range from about 30 micrometers to 1000 micrometers and a thickness in a range from about 10 micrometers to about 500 micrometers. The thickness of the first electrode 212 can be greater than the thickness of the second electrode 210 so that the electromagnetic interference between the adjacent pixel units 220 can be prevented.

The phosphor layer 218 is located on the top surface of the second electrode 210. The phosphor layer has the same shape as that of the second electrode 210. The phosphor layer 218 can be white phosphor layer, red phosphor layer, green phosphor layer, or blue phosphor layer. The phosphor layer 218 can be formed by printing, coating, or depositing. The thickness of the phosphor layer 218 can be selected according to need. In one embodiment, the thickness of the phosphor layer 218 is in a range from about 5 micrometers to about 50 micrometers.

The electron emitter 208 is located on the first electrode 212. The electron emitter 208 can be linear emitter such as silicon wires, carbon nanotubes, carbon fibers or carbon nanotube wires. The lengthwise direction of the electron emitter 208 can be parallel to the surface of the insulating substrate 202. The electron emission portion 222 of the electron emitter 208 points to the second electrode 210 and spaced from the second electrode 210 by a distance in a range from about 2 micrometers to about 500 micrometers. In one embodiment, the distance between the electron emission portion 222 and the second electrode 210 is in a range from about 50 micrometers to about 300 micrometers. In one embodiment, the electron emission portion 222 can extend above the phosphor layer 218.

In one embodiment, the electron emitter 208 includes a number of carbon nanotube wires located in at least two cells 214, and evenly spaced from and in parallel with each other. All the carbon nanotube wires can be arranged to form L-shaped, U-shaped, C-shaped, semicircular-shaped or ring-shaped to surround the second electrode 210 or locate on at least two opposite sides of the second electrode 210. The length of the carbon nanotube wires can be in a range from about 10 micrometers to about 1 centimeter. The distance between each two adjacent carbon nanotube wires can be in a range from about 10 micrometers to about 500 micrometers. One end of the carbon nanotube wire is fixed on the first electrode 212 by a fixing electrode 224 or conductive adhesive (not shown). The carbon nanotube wire can be a substantially pure structure of the carbon nanotubes, with few impurities. The carbon nanotube wire is a free standing structure.

The carbon nanotube wire includes a plurality of successive carbon nanotubes joined end to end by van der Waals attractive force therebetween. The carbon nanotubes in the carbon nanotube wire can be single-walled, double-walled, or multi-walled carbon nanotubes. The carbon nanotube wire can be untwisted or twisted. The untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. The twisted carbon nanotube wire includes a plurality of carbon nanotubes helically oriented around an axial direction of the twisted carbon nanotube wire.

The electron emitter 208 can be formed by disposing and heating a carbon nanotube slurry layer or disposing and cutting a carbon nanotube film. The carbon nanotube slurry layer includes a number of carbon nanotubes, a glass powder, and an organic carrier. The organic carrier is volatilized during the heating process. The glass powder can be melted and solidified to form a glass layer to fix the carbon nanotubes on the first electrodes 212 during the heating and cooling process.

In one embodiment, the electron emitter 208 is made by the steps of:

step (a), providing two carbon nanotube films;

step (b), placing the two carbon nanotube films on the first electrode 212 and the second electrode 210 to cover all of the first electrodes 212 and the second electrodes 210, wherein an angle between the aligned directions of the carbon nanotubes in the two adjacent carbon nanotube films is about 90°; and step (c), breaking the two carbon nanotube films to form a number of carbon nanotube wires spaced from and parallel with each other.

In step (a), the carbon nanotube film can be drawn from a carbon nanotube array. Examples of carbon nanotube film are taught by U.S. Pat. No. 7,045,108 to Jiang et al., and WO 2007015710 to Zhang et al. The carbon nanotube film includes a plurality of successive and oriented carbon nanotubes joined end-to-end by van der Waals attractive force therebetween, and arranged along the same direction. The carbon nanotube film is a free-standing film. The term "free-standing film" means that the film can sustain the weight of itself when it is hoisted by a portion thereof without any significant damage to its structural integrity.

In step (b), the carbon nanotubes of the carbon nanotube film extend from the first electrode 212 to the second electrode 210. If the first electrode 212 is ring-shaped, more than two carbon nanotube films can be stacked with each other. The angle between the aligned directions of the carbon nanotubes in the adjacent carbon nanotube films can range from about 0° to about 90°.

Furthermore, the carbon nanotube films are treated with a volatile organic solvent in step (b). The organic solvent is applied to soak the entire surface of the carbon nanotube film. During the soaking, adjacent parallel carbon nanotubes in the carbon nanotube film will bundle together, due to the surface tension of the organic solvent as it volatilizes, and thus, the carbon nanotube film will be shrunk into untwisted carbon nanotube wire. The organic solvent can be ethanol, methanol, acetone, dichloroethane, or chloroform.

In step (c), the carbon nanotube film can be cut by a laser beam, an electron beam, or can be broken by heat. In one embodiment, the carbon nanotube film is cut by a laser beam. The laser beam can be moved along the first electrode down-leads 204 and the second electrode down-leads 206 to remove the carbon nanotubes between the adjacent pixel units 220. The laser beam can be moved around the second electrode 210 to break the carbon nanotubes between the first electrode 212 and the second electrode 210. Also, the laser beam can be moved to remove the carbon nanotubes on the second electrode 210. The power of the laser beam can be in a range from about 10 W to about 50 W. The scanning speed of the laser beam can be in a range from about 0.1 mm/sec to about 10,000 mm/sec. The width of the laser beam can be in a range from about 1 micrometer to about 400 micrometers.

Further the field emission display 200 can include a driving circuit (not shown) to drive the field emission display 200 to display. The driving circuit can control the pixel units 220 via the electrode down-leads 204, 206 to display a dynamic image. The field emission display 200 can be used in a field of advertisement billboard, newspaper, or electronic book. In use, the field emission display 200 should be sealed in a vacuum.

Figure 3:
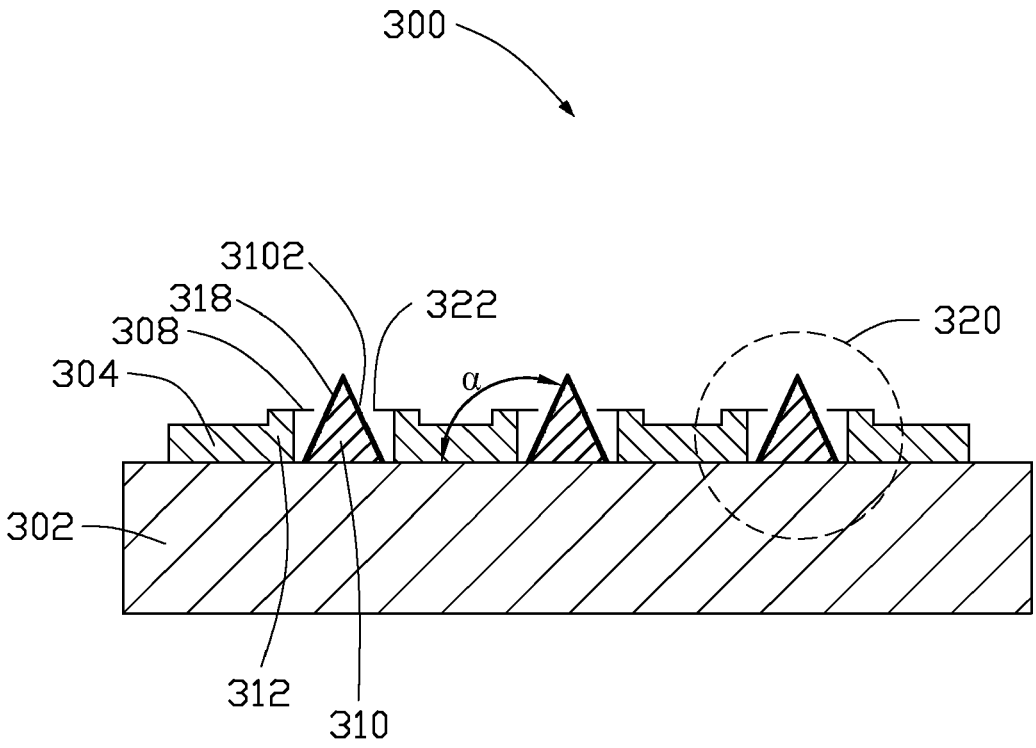
FIG. 3 is a schematic, cross-sectional view of one embodiment of a field emission display.

Referring to FIG. 3, a field emission display 300 of one embodiment includes an insulating substrate 302, a number of substantially parallel first electrode down-leads 304, a number of substantially parallel second electrode down-leads (not shown), and a number of pixel units 320. The field emission display 300 is similar to the field emission display 200 except that the second electrode 310 has a bearing surface 3102 inclined to the insulating substrate 302, and the phosphor layers 318 is located on the bearing surface 3102 and exposed to the electron emitter 308.

The bearing surface 3102 can be flat or curved. If the bearing surface 3102 is flat, an angle $\alpha$ between the bearing surface 3102 and the surface of the insulating substrate 302 can be greater than 90 degrees and less than 180 degrees. In one embodiment, the angle $\alpha$ between the bearing surface 3102 and the surface of the insulating substrate 302 is in a range from about 120 degrees to about 150 degrees. If the bearing surface 3102 is curved, the bearing surface 3102 can be a convex surface or a concave surface. The bearing surface 3102 can intersect with the insulating substrate 302 or can be spaced from the insulating substrate 302.

In one embodiment, the second electrode 310 is rectangular pyramid and has four flat bearing surfaces 3102 adjacent to and exposed to the electron emitter 308 around the second electrode 310. Four phosphor layers 318 are located on the four bearing surfaces 3102 respectively and exposed to the electron emission portion 322. Because the phosphor layers 318 are located on the bearing surface 3102 of the second electrode 310 so that the phosphor layer 318 has a relative larger area and bombarded easily by the electron emitted from the electron emitter 308. Thus, the brightness of the field emission display 300 is improved.

The second electrode 310 can be formed by screen printing a number of stacked square conductive slurry layers repeatedly. The length side of the conductive slurry layer decreases gradually. Because of the high flowability of the conductive slurry, four inclines can be formed to be used as the bearing surface 3102.

Figure 4:
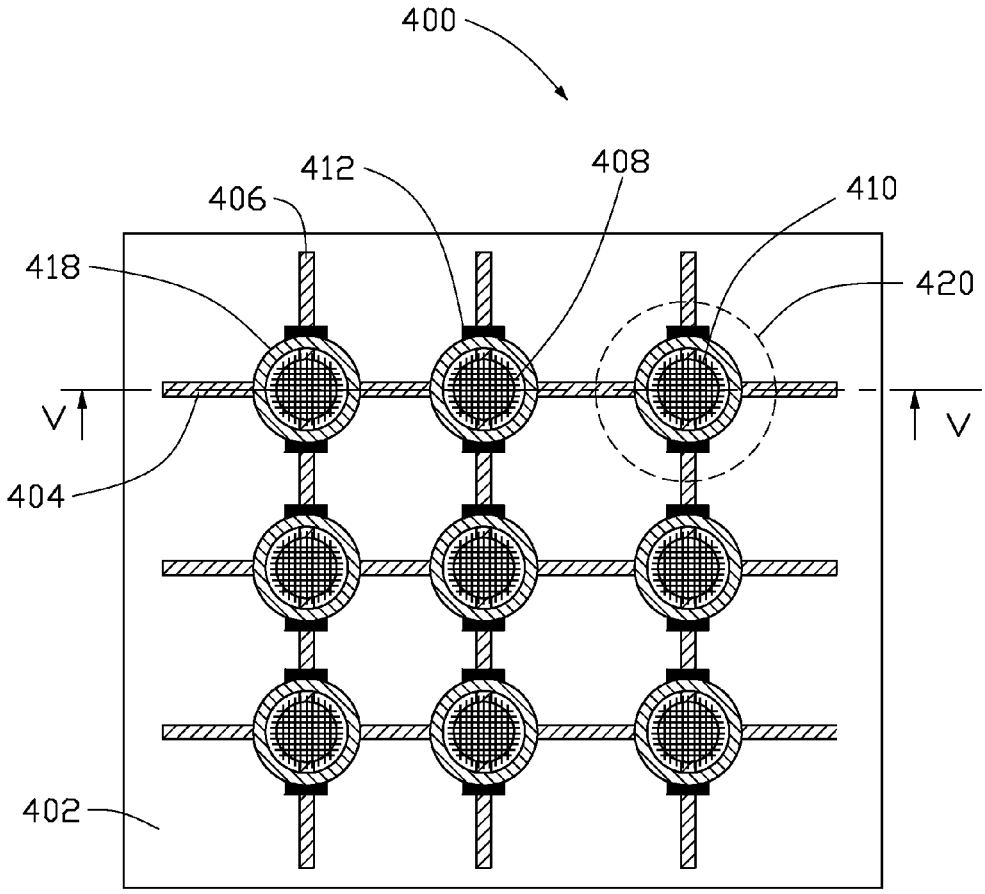
FIG. 4 is a schematic, top view of one embodiment of a field emission display.
Figure 5:
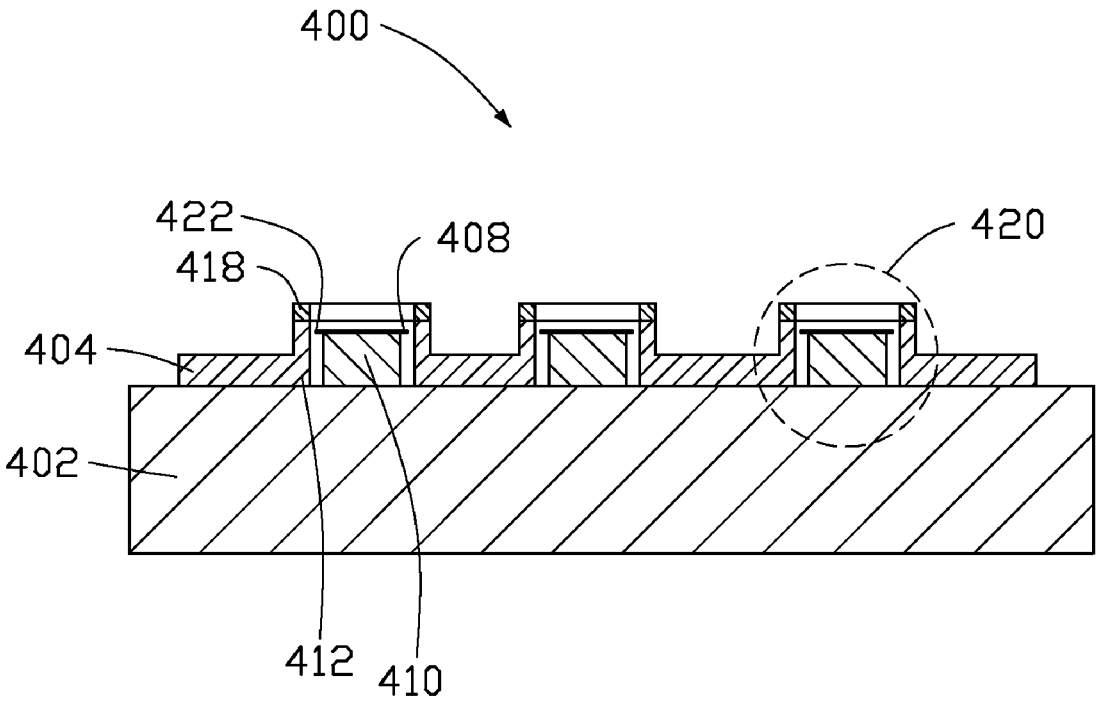
FIG. 5 is a schematic, cross-sectional view, along a line V-V of FIG. 4.

Referring to FIGS. 4 and 5, a field emission display 400 of one embodiment includes an insulating substrate 402, a number of substantially parallel first electrode down-leads 404, a number of substantially parallel second electrode down-leads 406, and a number of pixel units 420. The field emission display 400 is similar to the field emission display 200 except that the first electrode 412 is ring-shaped and used as an anode electrode, the second electrode 410 is round and used as a cathode electrode, the electron emitters 408 are connected to the second electrode 410, and the phosphor layer 418 is located on the first electrode 412.

In one embodiment, the phosphor layer 418 is located on the first electrode 412 to form a ring around the second electrode 410. The electron emitters 408 are located on a top surface of the second electrode 410. The electron emitter 408 includes a number of electron emission portions 422 arranged to form a ring and pointing to the phosphor layer 418. In one embodiment, the electron emitters 408 include a number of carbon nanotube wires crossed with each other and having two opposite ends extending to the first electrode 412. Because the phosphor layer 418 is located on the first electrode 412 to form a ring around the second electrode 410, and the electron emitter 408 includes a number of electron emission portions 422 arranged to form a ring and pointing to the phosphor layer 418, the brightness and uniformity of the field emission display 400 is further improved.

Figure 6:
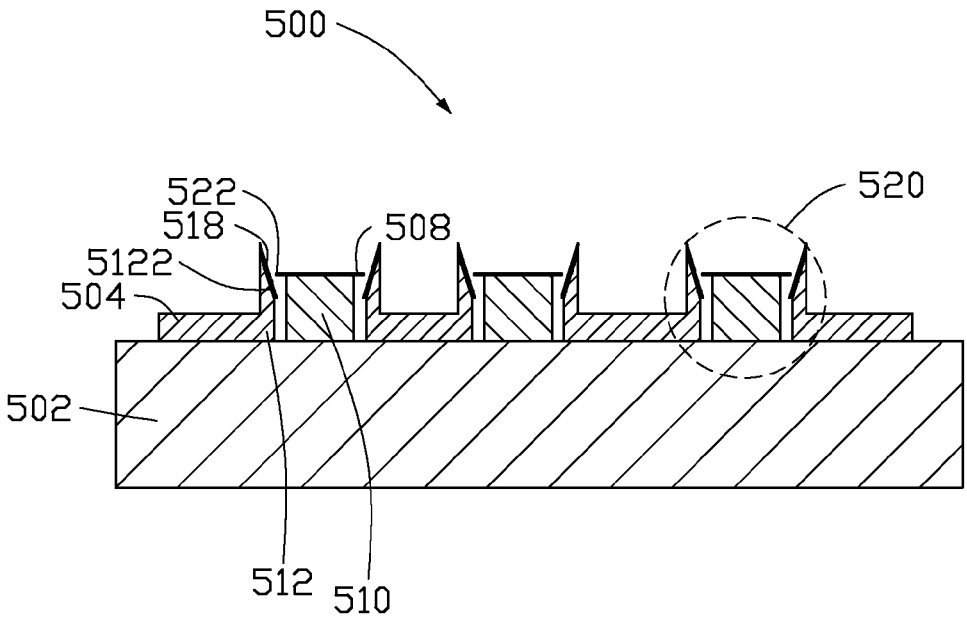
FIG. 6 is a schematic, cross-sectional view of one embodiment of a field emission display.

Referring to FIG. 6, a field emission display 500 of one embodiment includes an insulating substrate 502, a number of substantially parallel first electrode down-leads 504, a number of substantially parallel second electrode down-leads (not shown), and a number of pixel units 520. The field emission display 500 is similar to the field emission display 400 except that the first electrode 512 has a bearing surface 5122 inclined to the insulating substrate 502, and the phosphor layer 518 is located on the bearing surfaces 5122 of the first electrode 512.

In one embodiment, the width of the first electrode 512 decreases along a direction away from the insulating substrate 502 so that the first electrode 512 has a bearing surface 5122 around and exposed to the electron emitter 508. The electron emitter 508 includes a number of electron emission portions 522 arranged to form a ring and pointing to the phosphor layer 518 on the bearing surface 5122. Because the first electrode 512 has bearing surfaces 5122 around and exposed to the electron emitter 508, the phosphor layer 518 located on the bearing surfaces 5122 has a maximum area and is bombarded easily by the electron emitted from the electron emitter 508. Thus, the brightness and uniformity of the field emission display 500 is further improved.

Figure 7:
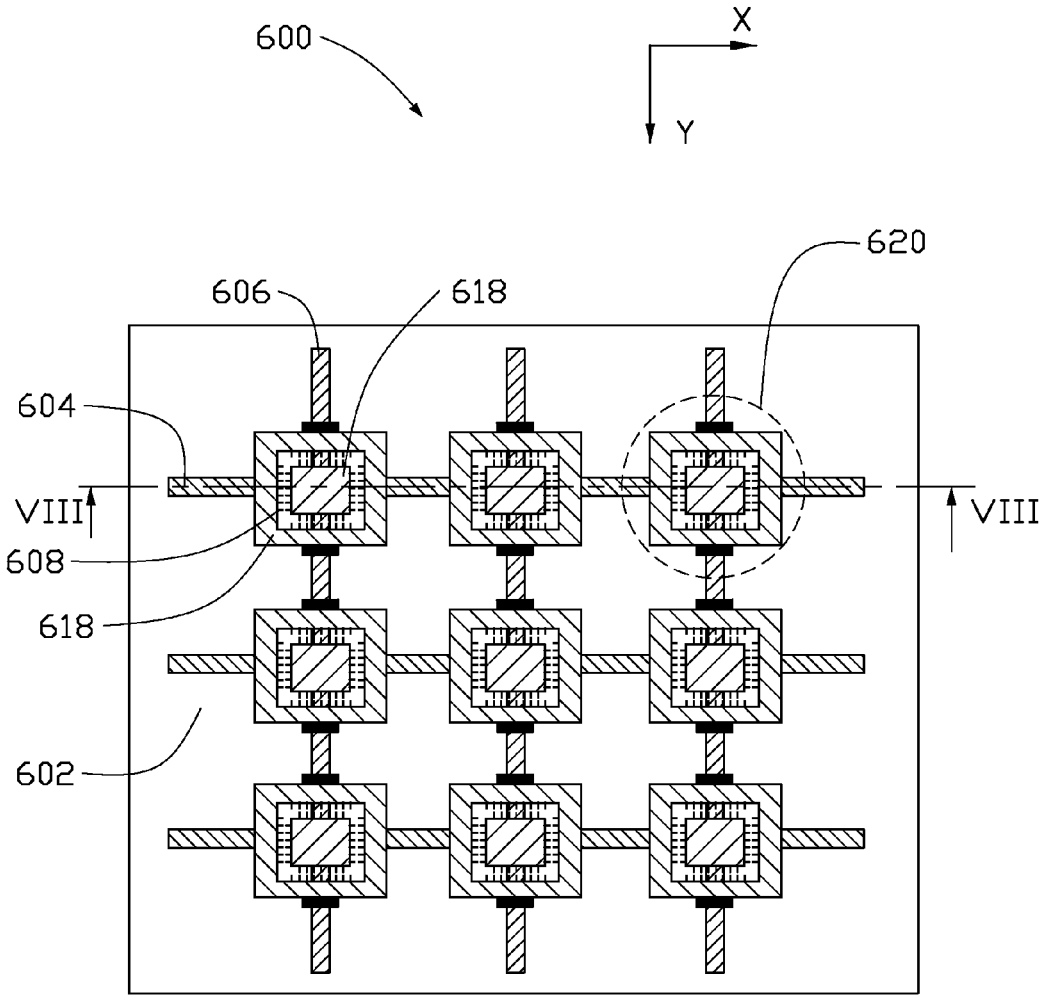
FIG. 7 is a schematic, top view of another embodiment of a field emission display.
Figure 8:
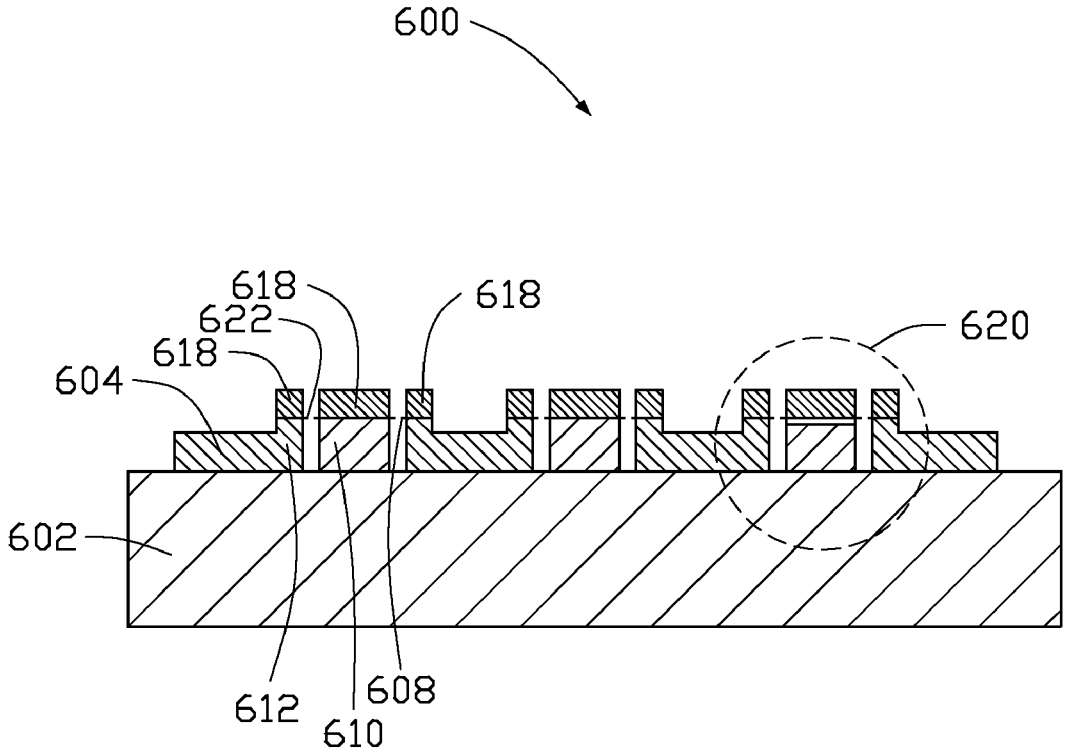
FIG. 8 is a schematic, cross-sectional view, along a line VIII-VIII of FIG. 7.

Referring to FIGS. 7 and 8, a field emission display 600 of one embodiment includes an insulating substrate 602, a number of substantially parallel first electrode down-leads 604, a number of substantially parallel second electrode down-leads 606, and a number of pixel units 620. The field emission display 600 is similar to the field emission display 200 except that both the first electrode 612 and the second electrode 610 have the electron emitter 608 and the phosphor layer 618 located thereon.

In one embodiment, the electron emitter 608 includes a number of first carbon nanotube wires located on the first electrode 612 and a number of second carbon nanotube wires located on the second electrode 610. Two phosphor layers 618 are located on the first electrode 612 and the second electrode 610 respectively to cover the electron emitter 608. The carbon nanotube wires on the first electrode 612 extend to the second electrode 610 and have a number of electron emission portions 622 pointing to the phosphor layers 618 on the second electrode 610. The carbon nanotube wires on the second electrode 610 extend to the first electrode 612 and have a number of electron emission portions 622 pointing to the phosphor layers 618 on the first electrode 612. Both the first electrode 612 and the second electrode 610 can be used as an anode or cathode. In one embodiment, an alternating voltage can be supplied to the first electrode 612 and the second electrode 610 so the first electrode 612 and the second electrode 610 can be used as the anode and cathode alternately in the emission display 600. Thus, the field emission display 600 can have an improved lifespan.

Figure 9:
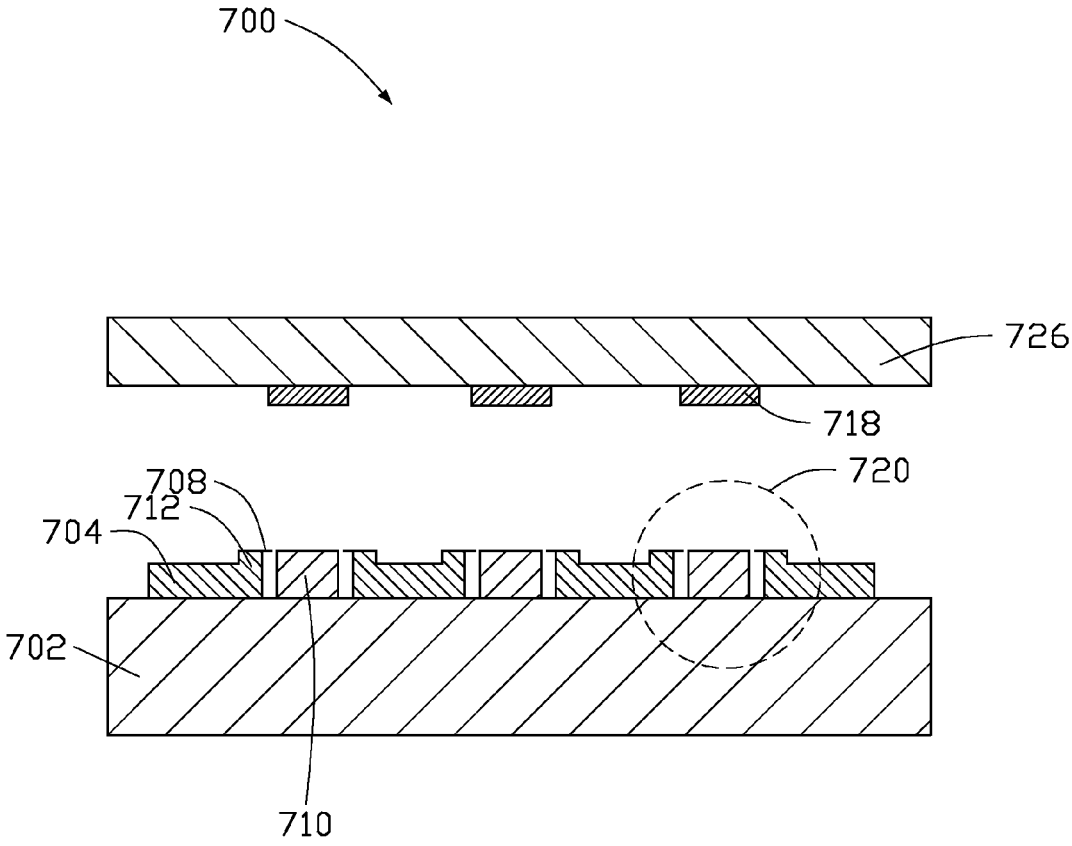
FIG. 9 is a schematic, cross-sectional view of one embodiment of a field emission display.

Referring to FIG. 9, a field emission display 700 of one embodiment includes an insulating substrate 702, a number of substantially parallel first electrode down-leads 704, a number of substantially parallel second electrode down-leads (not shown), and a number of pixel units 720. The field emission display 700 is similar to the field emission display 200 except that the field emission display 700 further includes a third electrode 726 spaced from and substantially parallel to the insulating substrate 702, and the phosphor layer 718 is located on the third electrode 726 and exposed to the electron emitter 708.

In one embodiment, a number of phosphor layers 718 are located on the third electrode 726. Each of the phosphor layers 718 is located corresponding to one of the pixel units 720. In use, the first electrode 712 is used as a cathode, the second electrode 710 is used as a gate, and the third electrode 726 is used as an anode. The electron emitter 708 can emit electrons under the electric field of the second electrode 710. The electrons can move toward the third electrode 726 under the electric field of the third electrode 726 to bombard the phosphor layers 718 to light.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A field emission device, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads is set an angle relative to the plurality of second electrode down-leads to define a grid having a plurality of cells and a plurality of intersections; and a plurality of electron emission units, wherein each of the plurality of electron emission units is positioned at one of the plurality of intersections and in at least two adjacent cells, and each of the plurality of electron emission units comprises:

a first electrode located on the insulating substrate;

a second electrode located on the insulating substrate and spaced from the first electrode, wherein the second electrode extends surrounding the first electrode; and a plurality of electron emitters located on and electrically connected to at least one of the first electrode and the second electrode.

2. The field emission device of claim 1, wherein the second electrode is L-shaped, U-shaped, C-shaped, semicircular-shaped or ring-shaped.

3. The field emission device of claim 2, wherein the plurality of electron emitters is located on the second electrode and arranged to form a same shape as that of the second electrode.

4. The field emission device of claim 1, wherein the second electrode is ring-shaped and located around the first electrode, and a thickness of the second electrode is greater than a thickness of the first electrode to prevent electromagnetic interference between adjacent electron emission units.

5. The field emission device of claim 4, wherein each of the plurality of electron emission units is located in four adjacent cells.

6. The field emission device of claim 4, wherein the plurality of electron emitters is located on the second electrode and comprises a plurality of ends arranged to form a ring-shape and pointing to the first electrode.

7. The field emission device of claim 4, wherein the plurality of electron emitters is located on the first electrode and comprises a plurality of first ends arranged to form a ring-shape and pointing to the second electrode.

8. The field emission device of claim 7, wherein the plurality of electron emitters comprises a plurality of carbon nanotube wires in parallel with each other.

9. The field emission device of claim 1, wherein each of the plurality of electron emission units comprises a plurality of first electron emitters electrically connected to the first electrode, and a plurality of second electron emitters electrically connected to the second electrode.

10. The field emission device of claim 9, wherein an alternating voltage is supplied to the first electrode and the second electrode such that the first electrode and the second electrode are used as an anode and a cathode alternately.

11. A field emission display, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads is set an angle relative to the plurality of second electrode down-leads to define a grid having a plurality of cells and a plurality of intersections; and a plurality of pixel units, wherein each of the plurality of pixel units is positioned at one of the plurality of intersections and in at least two adjacent cells, and each of the plurality of pixel units comprises:

a cathode electrode located on the insulating substrate;

an electron emitter electrically connected to the cathode electrode;

an anode electrode located on the insulating substrate and spaced from the cathode electrode, wherein the anode electrode extends surrounding the cathode electrode; and a phosphor layer located on the anode electrode and extending to surround the cathode electrode.

12. The field emission display of claim 11, wherein the anode electrode is L-shaped, U-shaped, C-shaped, semicircular-shaped, or ring-shaped, and the phosphor layer has a same shape as that of the anode electrode.

13. The field emission display of claim 11, wherein each of the plurality of electron emission units is located in four adjacent cells, the anode electrode is ring-shaped and located around the cathode electrode, and a thickness of the anode electrode is greater than a thickness of the cathode electrode to prevent electromagnetic interference between adjacent pixel units.

14. The field emission display of claim 13, wherein the electron emitter comprises a plurality of electron emission portions arranged to form a ring-shape and pointing to the phosphor layer.

15. The field emission display of claim 11, wherein the anode electrode has a bearing surface inclined to the insulating substrate, and the phosphor layer is located on the bearing surface.

16. A field emission display, comprising:

an insulating substrate;

a plurality of first electrode down-leads substantially parallel to each other and located on the insulating substrate;

a plurality of second electrode down-leads substantially parallel to each other and located on the insulating substrate, wherein the plurality of first electrode down-leads is set an angle relative to the plurality of second electrode down-leads to define a grid having a plurality of cells and a plurality of intersections; and a plurality of pixel units, wherein each of the plurality of pixel units is positioned at one of the plurality of intersections and in at least two adjacent cells, and each of the plurality of pixel units comprises:

a first electrode located on the insulating substrate;

a first phosphor layer located on the first electrode;

a plurality of first electron emitters electrically connected to the first electrode, wherein at least part of each of the plurality of first electron emitters is located between the first electrode and the first phosphor layer;

a second electrode located on the insulating substrate and spaced from the first electrode, wherein the second electrode extends surrounding the first electrode;

a second phosphor layer located on the second electrode;

a plurality of second electron emitters electrically connected to the second electrode and arranged to surround the first electrode, wherein at least part of each of the plurality of second electron emitters is located between the second electrode and the second phosphor layer.

17. The field emission display of claim 16, wherein the second electrode is L-shaped, U-shaped, C-shaped, semicircular-shaped, or ring-shaped, and the plurality of second electron emitters are arranged to form a same shape as that of the second electrode.

18. The field emission display of claim 16, wherein each of the plurality of pixel units is located in four adjacent cells, the second electrode is ring-shaped and located around the first electrode, a thickness of the second electrode is greater than a thickness of the first electrode to prevent electromagnetic interference between adjacent pixel units.

19. The field emission display of claim 16, wherein an alternating voltage is supplied to the first electrode and the second electrode such that the first electrode and the second electrode are used as an anode and a cathode alternately.

* * * * *